United States Patent [19]

Dantlgraber

[11] Patent Number: 4,626,181

[45] Date of Patent: Dec. 2, 1986

[54] ROTARY HYDROSTATIC MACHINE WITH HEATED CENTER HOUSING PORT

[75] Inventor: Jörg Dantlgraber, Lohr-Sackenbach, Fed. Rep. of Germany

[73] Assignee: Mannesmann Rexroth GmbH, Lohr, Fed. Rep. of Germany

[21] Appl. No.: 828,891

[22] Filed: Feb. 13, 1986

Related U.S. Application Data

[63] Continuation of Ser. No. 654,932, Sep. 27, 1984, abandoned.

[30] Foreign Application Priority Data

Oct. 3, 1983 [DE] Fed. Rep. of Germany ..... 3335879

[51] Int. Cl.[4] ..... F03C 2/00; F04C 2/00; F04C 15/00

[52] U.S. Cl. ..... 418/83; 418/102

[58] Field of Search ..... 418/30, 31, 83, 85, 418/86, 95, 102

[56] References Cited

U.S. PATENT DOCUMENTS

| | | | |
|---|---|---|---|
| 1,886,751 | 11/1932 | Shreiber | 418/86 |
| 3,272,138 | 9/1966 | Connoy et al. | 418/102 |
| 3,975,122 | 8/1976 | Hackbarth et al. | 418/83 |

FOREIGN PATENT DOCUMENTS

| | | |
|---|---|---|
| 709567 | 8/1941 | Fed. Rep. of Germany . |
| 3247885 | 12/1982 | Fed. Rep. of Germany . |

*Primary Examiner*—John J. Vrablik

*Attorney, Agent, or Firm*—Cushman, Darby & Cushman

[57] ABSTRACT

A hydrostatic machine having a rotor mounted in a housing and having a leakage oil connection, the leakage oil being conducted before discharge to the tank through predetermined housing portions in order to heat the central part of the housing during the start-up phase of the machine.

5 Claims, 3 Drawing Figures

ROTARY HYDROSTATIC MACHINE WITH HEATED CENTER HOUSING PORT

This is a continuation of application Ser. No. 654,932, filed Sept. 27, 1984, which was abandoned upon the filing hereof.

FIELD OF THE INVENTION

The invention relates generally to hydraulic pumps, but more specifically the invention relates to hydraulic motors. In particular, the invention relates to vane cell or other chamber pumps but also vane cell and other chamber motors.

BACKGROUND OF THE INVENTION

In known hydraulic machines comprising a rotor in a housing, in particular pumps, the rotor must have a relatively large running clearance with respect to the associated housing parts so that no disadvantages occur due to different thermal expansion of the rotor and housing. For example, on starting a cold pump the rotor temperature $T_R$ (measured in the region of the rotor width) and the temperature $T_G$ of the housing in the region of the rotor (e.g. the temperature $T_G$ of the housing center part) exhibit a very different variation as a function of time. As a result, at a certain instant a very large temperature difference $T_R$-$T_G$ results so that due to thermal expansion a reduction of the axial clearance between the rotor and the associated planar faces of the housing occurs. To prevent seizure of the rotor at this instant the axial clearance must therefore be made correspondingly large which leads to an increase in the volumetric losses and a reduction in efficiency.

SUMMARY OF THE INVENTION

The invention is based quite generally on the problem of avoiding the disadvantages of the prior art and in particular constructing a hydrostatic machine in such a manner that low volumetric losses and thus a high efficiency can be achieved in a simple manner.

For solving this problem the invention provides in a hydrulic machine a rotor mounted in a housing and a leakage oil connection, so that the leakage oil is conducted before being discharged to the tank through predetermined housing portions.

BRIEF DESCRIPTION OF THE DRAWINGS

Further advantages, objectives and details of the invention will be apparent from the description of the examples of the embodiments with the aid of the drawings, wherein.

DETAILED DESCRIPTION OF THE INVENTION

Figure 1:
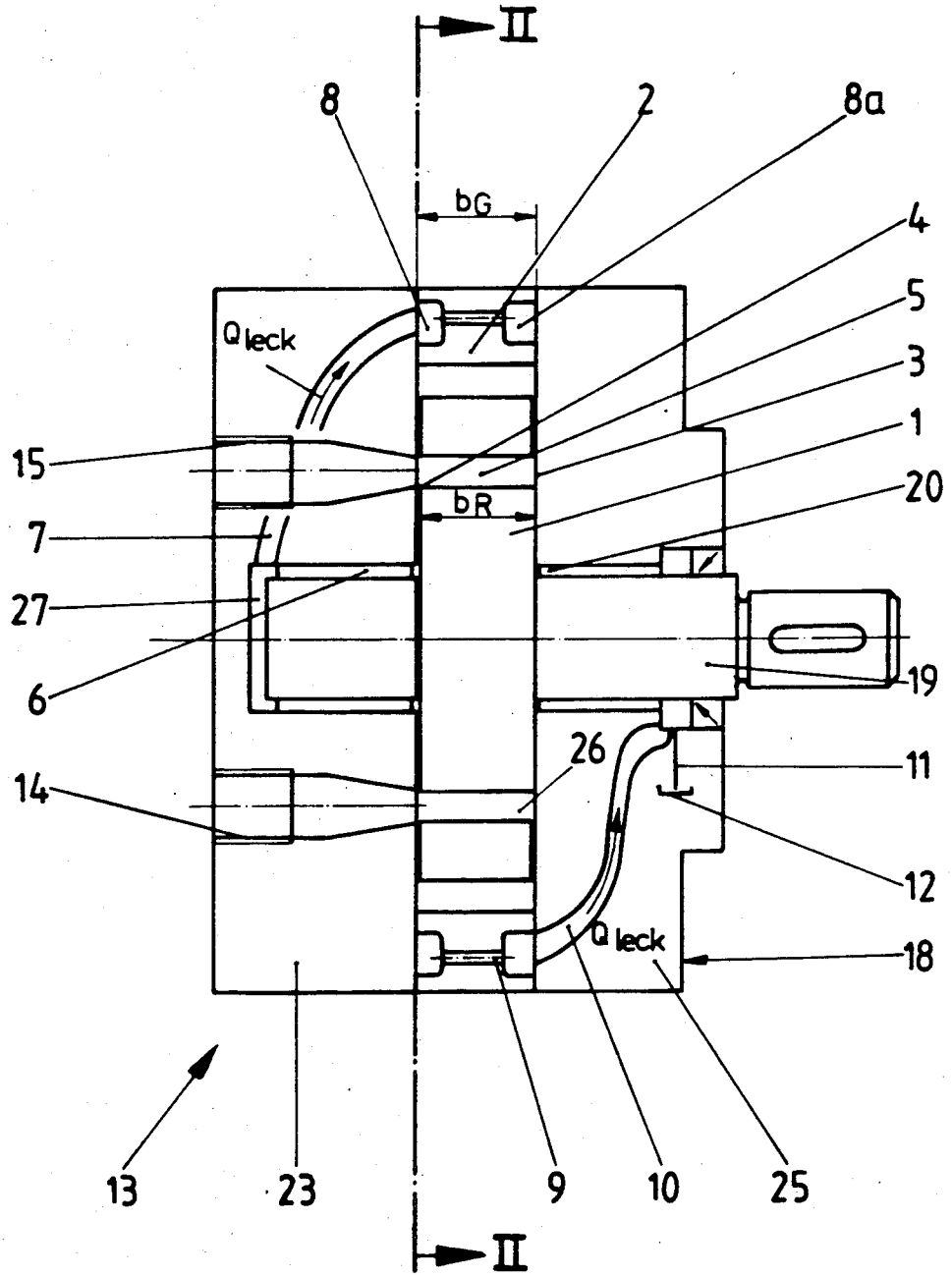
FIG. 1 is a schematic longitudinal section through a vane cell pump according to the invention.
Figure 2:
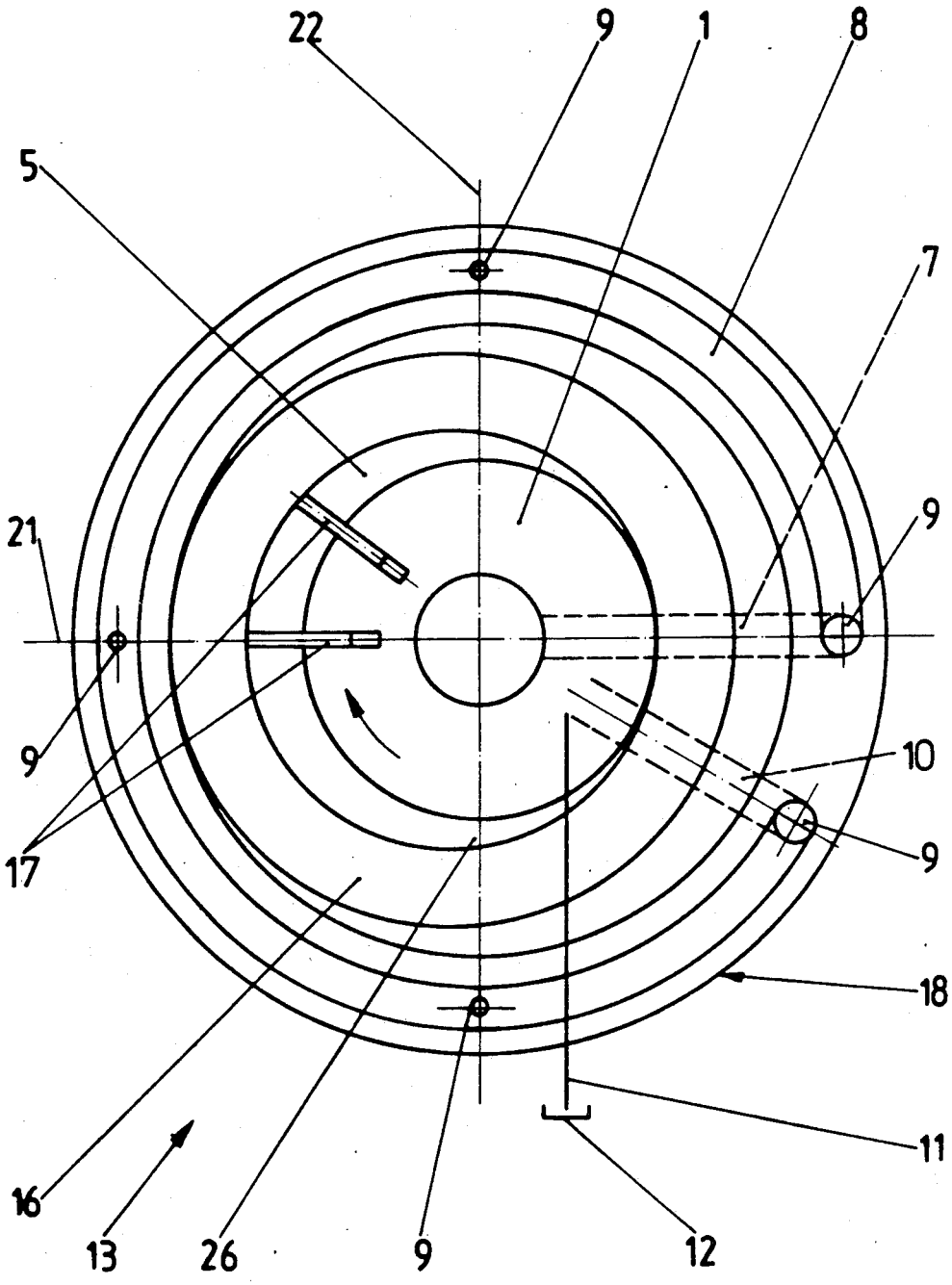
FIG. 2 is a section along the line II—II of FIG. 1.

In FIGS. 1 and 2 a vane cell pump 13 is illustrated schematically. The vane cell pump 13 comprises a housing 18 in which a rotor 1 disposed on a shaft 19 is rotatably mounted. The shaft 19 projects on both sides out of the rotor 1 and with its end ending in the housing 19 is mounted by means of a bearing 6 while the end of the shaft 19 projecting out of the housing 18 is mounted by means of a bearing 20. The width of the rotor 1 is denoted by $b_R$. The rotor 1 carries at its outer periphery in known manner vanes 17; for reasons of simplicity only a few vanes are illustrated. The free ends of said vanes 17 are in contact with the inner periphery of a cam ring 16. The cam ring 16 is adjustable for setting the displacement in known manner along the transverse axis 21 (FIG. 2). Furthermore, the cam ring 16 may also be adjustable for setting the suction instant in the direction of the axis 22 which in turn extends perpendicularly to the transverse axis 21. Also for reasons of simplicity, the mounting of the cam ring 16 within the housing 18 is not shown in detail. A preferred mounting of the ring is described in German patent application P No. 32 47 885.2. Express reference is made to the latter application of which for disclosure reasons a copy is enclosed.

In the example of the embodiment illustrated, the housing 18 comprises a cover 23, a center part 2 and a flange part 25 giving together the sandwich-like structure shown in FIG. 1.

Formed in the cover 23 is an inlet 14 which communicates with the suction chamber 26 of the pump 13. On clockwise rotation of the rotor 1, cf. FIG. 2, the fluid, for example hydraulic oil, in the suction chamber 26 is continuously compressed and finally reaches the pressure chamber 5 from which the hydraulic oil brought to the system pressure leaves the pump 13 through the outlet 15.

Planar faces 3 and 4 are formed at the respective inner sides of the cover 23 and flange part 25 and lie parallel to corresponding planar faces of the rotor 1. The distance between these two planar faces 3 and 4 is denoted by $b_G$ and in the example of the embodiment according to FIG. 1 depends substantially on the center part 2. The running clearance of the rotor 1 corresponds to the difference of the dimensions $b_G$-$b_R$ (cf. FIG. 1).

Figure 3:
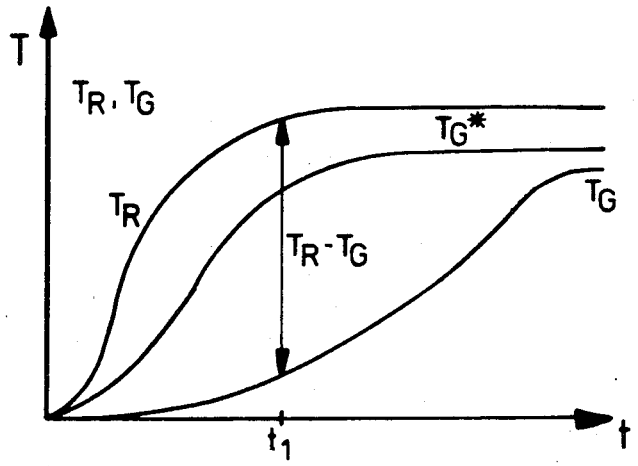
FIG. 3 is an illustration of the temperature of certain components of the pump as a function of time.

When the cold pump is started the variations as a function of time of the temperature $T_R$ of the rotor 1 (measured in the region of the rotor width $b_R$) and the temperature $T_G$ of the housing center part 2 differ greatly as indicated schematically in FIG. 3. It is seen that at a certain instant $t_1$ there is a very large temperature difference $T_R$-$T_G$. This large temperature difference leads, due to the thermal expansion, to a reduction in the axial clearance between the rotor 1 and the planar surfaces 3 and 4. To avoid seizure of the rotor 1 at the instant $t_1$, of the large temperature difference the axial clearance must be made correspondingly large and this leads to an increase in the volumetric losses and a reduction in efficiency.

On the basis of this recognition the invention proposes measures for reducing the axial clearance between the rotor 1 and planar surfaces 3 and 4. The invention defines that by influencing the temperature of the rotor and of the housing an undesirable reduction of the axial clearance between the rotor 1 and planar surfaces 3 and 4 is avoided.

According to a preferred further development of the invention the middle portion of the housing, the center part 2, of the example of the embodiment illustrated in FIG. 1, is heated. This heating of the center part 2 results in practically no reduction occurring in the axial clearance between the rotor 1 and the planar surfaces 3 and 4. According to a preferred example of the embodiment the hydraulic oil in any case present in the pump 13 is used for the heating, in particular the leakage oil which in a hydrostatic machine has the highest oil temperature which occurs in the machine. To enable this leakage oil to be used for heating the housing center part 2, according to the example of the embodiment of FIGS. 1 and 2 in particular, the following is provided:

As is known, the great part of the leakage oil flows from the pressure chamber 5 through the gap between the planar surface 4 and the adjacent planar surface of the rotor 1 and then passes through the bearing 6 to a space 27. In conventional vane cell pumps the leakage oil runs from said space 27 through an axial bore, not shown, in the shaft 19 to the end of the shaft 19 projecting from the housing and from there the leakage oil passes via a transverse bore also not shown via the leakage oil connection 11 to the tank 12.

Now, according to the invention the leakage oil, in particular the leakage oil in the space 27, is used for heating the housing center portion 2. For this purpose in the cover a supply passage 7 is formed which originates from the space 27, extends into the pump housing and terminates at the inner planar surface 4 of the cover 23. The supply passage 7 terminates in the region of the housing center part 2. Preferably, in the planar face of the housing center part 2 facing the planar surface 4 an annular passage 8 is formed which, cf. FIG. 2, is not closed. On the oppositely disposed planar surface of the housing center part 2 an unclosed annular passage 8*a* is also formed. The annular passage 8 communicates with the annular passage 8*a* via bores 9. A plurality of bores is provided over the periphery as indicated schematically in FIG. 2. The leakage oil supplied via the supply passage 7 to the annular passage 8 runs through the bores 9 and thus passes into the annular passage 8*a* from where said oil is conducted via a passage 10 to the leakage oil connection 11 and finally to the tank 12. The passage 10 is formed in the flange part 25 and has its inlet end in the region of the annular passage 8*a*. The outlet end terminates for example in a space which is adjacent but outwardly offset with respect to the bearing 20 from where the leakage oil can then flow to the leakage oil connection 11.

Due to the flowing through of the passages 8 and 8*a* and in particular because the heated leakage oil flows through the bores 9, parts of the heat energy contained in the oil is transferred to the housing center part 2 and as a result the temperature thereof $T_G$* follows the rotor temperature $T_R$ with a slight delay as illustrated in FIG. 3. In this manner it is possible to keep the axial clearance during the warming-up operation of the pump almost constant.

Although the above invention has been described with reference to a vane cell pump, and is also preferred therefor, it is pointed out that the invention can also be used in similar manner in a vane cell motor. The invention can moreover be used in other chamber pumps and chamber motors in a similar manner.

I claim:

1. A hydrostatic machine comprising:

a housing including a center part, a flange part and a cover forming a sandwich-like structure;

a rotor rotatably mounted in said housing by means of bearings, said rotor carrying at its outer periphery a plurality of vanes adapted to define pressure and suction chambers for hydraulic oil;

space means defined in said housing and being adapted to receive leakage oil originating from said pressure chambers;

first passage means provided in said cover;

annular second passage means defined in said center part; and third passage means defined in said flange part;

said first passage means being adapted to provide a leakage oil connection from said space means to said annular second passage means, and said annular second passage means being in leakage oil connection with said third passage means via said center part;

said space means, first passage means, annular second passage means and third passage means being provided so that said leakage oil flowing therethrough causes thermal expansion of said center part which substantially matches thermal expansion of said rotor.

2. The hydrostatic machine of claim 1, wherein said annular second passage means is provided at a first end face of the center part and an annular fourth passage means is disposed at the opposite and second end face of the center part, and said annular second passage means is connected to said annular fourth passage means by means of pores provided in said center part.

3. The hydrostatic machine of claim 1, wherein said third passage means communicates with its inlet end with said annular fourth passage means.

4. The hydrostatic machine of claim 1, wherein said annular second passage means and said annular fourth passage means are open towards the respective first and second end faces of said center part.

5. The hydrostatic machine of claim 1, further comprising cam ring means for surrounding said rotor and for cooperating with said vanes to define said pressure and suction chambers.

* * * * *